US006411316B1

(12) United States Patent
Shigehiro et al.

(10) Patent No.: US 6,411,316 B1
(45) **Date of Patent: *Jun. 25, 2002**

(54) IMAGE DISPLAY MEDIUM, IMAGE-FORMING METHOD, IMAGE-FORMING APPARATUS AND INITIALIZER

(75) Inventors: Kiyoshi Shigehiro; Yoshiro Yamaguchi; Yoshinori Machida; Nobuyuki Nakayama; Shota Oba; Motohiko Sakamaki; Minoru Koshimizu; Takeo Kakinuma, all of Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/621,547

(22) Filed: Jul. 21, 2000

(30) Foreign Application Priority Data

Jul. 21, 1999 (JP) ..... 11-205959

(51) Int. Cl.[7] ..... B41M 5/00; B41J 2/41

(52) U.S. Cl. ..... 347/112; 345/107; 347/153; 359/296

(58) Field of Search ..... 347/111, 112, 347/151, 153; 430/19, 32, 41; 345/84, 107; 359/290, 296; 399/158, 131

(56) References Cited

U.S. PATENT DOCUMENTS 6,025,896 A * 2/2000 Hattori et al. ..... 349/86
6,045,955 A * 4/2000 Vincent ..... 430/45
6,184,856 B1 * 2/2001 Gordon et al. ..... 345/107

FOREIGN PATENT DOCUMENTS

JP 6-35370 * 2/1994

OTHER PUBLICATIONS

Kawai, "Development of Microcapsule–type Electrophoretic Display (digital Paper)", The Imaging Society of Japan, Electronic Imaging Seminar, 1999, pp. 31–36.
Jo et al., "New Toner Display Device (I)—Image Display Using Conductive Toner and Charge Transport Layer—", Japan Hardcopy '99 Proceedings, 1999, pp. 249–252.
Jo et al., "New Toner Display Device (II)", Japan Hardcopy '99 Fall Meeting Proceedings, 1999, pp. 10–13.
Kitamura et al., "Toner Display by Electrical Movement of Conductive Toner", The Institute of Image Information and Television Engineers, Technical Report vol. 224, No. 16, 2000, pp. 7–11.
Kawai et al., "Microcapsule–type Electrophoretic Display (MC–EPD)", Japan Hardcopy '99 Proceeding, 1999, pp. 237–240.

* cited by examiner

*Primary Examiner*—Joan Pendegrass
(74) *Attorney, Agent, or Firm*—Oliff & Berridge, PLC

(57) ABSTRACT

Provided are an image display medium which satisfies a safety and a high-speed response and which is capable of repetitive rewriting, an image-forming method in which an image can be formed on the image display medium, an image-forming apparatus, and an initializer. In the image display medium, conductive particles and insulating particles are interposed between a display substrate and a non-display substrate having a positive charge-transporting property. An electrostatic latent image adapted to the image is formed on an electrostatic latent image carrier. A bias voltage is applied to a counter electrode. Positive charges (non-image portion) on the electrostatic latent image carrier are transferred to the display substrate to charge the conductive particles. The charged conductive particles are moved toward the non-display substrate. In the uncharged portion (image portion) of the electrostatic latent image carrier, positive charges are transferred to the non-display substrate from the counter electrode to charge the conductive particles. The charged conductive particles are moved toward the display substrate.

17 Claims, 12 Drawing Sheets

IMAGE DISPLAY MEDIUM, IMAGE-FORMING METHOD, IMAGE-FORMING APPARATUS AND INITIALIZER

FIELD OF THE INVENTION

The present invention relates to an image display medium, an image-forming method, an image-forming apparatus, and an initializer. More specifically, it relates to an image display medium capable of repetitive rewriting, an image-forming method in which an image is formed on the image display medium, an image-forming apparatus, and an initializer.

DESCRIPTION OF THE RELATED ART

As a technology for displaying an image on so-called electronic paper, technologies such as twisting of color particles, electrophoresis, a thermal rewritable medium, a liquid crystal and electrochromy have been so far known. Of these technologies, there is an image display medium for conducting display with a toner in which a conductive color toner and white particles are interposed between a display substrate and a non-display substrate which are facing each other, and a charge-transferring layer is formed inside the non-display medium and a matrix electrode inside the display medium respectively. In such an image display medium, charges are injected in the conductive color toner through a charge transfer layer, and the conductive color toner in which charges are injected is moved by an electric field formed between substrates according to the image by the matrix electrode and is adhered to the display substrate. Consequently, the image as a contrast of the conductive color toner and the white particles is displayed on the display substrate.

Further, as an image display medium capable of repetitive rewriting, an image display medium using electrophoresis has been known (Kawai, Development of Electrophoresis Display Using Microcapsules, *Nippon Gazoh Gakkai, Electronic Imaging Kenkyukai*, p.31, 1999).

However, since the matrix electrode is employed in the image display medium using the toner, the medium cannot directly be applied to an ordinary image-forming apparatus in which an image is formed by developing an electrostatic latent image formed on an image carrier with a toner and transferring the same onto recording paper, such as a copier or a printer. In addition, the image display medium using the electrophoresis is problematic in that it is difficult to secure a safety of an insulating liquid or to provide a high-speed response.

SUMMARY OF THE INVENTION

The invention has been made to solve these problems, and provides an image display medium which satisfies a safety and a high-speed response and which is capable of repetitive rewriting, an image-forming method in which an image can be formed on the image display medium and which can be used in a copier or a printer in which an image is formed on recording paper, an image-forming apparatus, and an initializer.

According to an aspect of the invention, the invention provides an image display medium including a pair of substrates at least one of which has a charge-transporting property, and plural types of particle groups which are interposed movably by an electric field applied from outside and which are different in color and properties.

In this case, there is provided the image display medium in which between the pair of substrates at least one of which has the charge-transporting property, the particle groups movable by the electric field applied from outside, for example, an electric field generated by applying a DC voltage or an AC voltage between the substrates are interposed. These particle groups are different in color and properties. The properties are, for example, that the particles have a conductivity or an insulating property and the particles are charged positively or negatively. For example, according to another aspect of the invention, at least one type of the particle groups can be conductive particles. Since at least one of the substrates has a charge-transporting property, the particle groups can be charged by applying the electric field from outside.

Accordingly, the particle groups can be moved according to the image by applying the electric field according to the image to display the image by the contrast of the colors of the particle groups. Thus, the image can repetitively be displayed by applying the electric field from outside according to the image. At least two types of colors of the particle groups are sufficient. The particle groups may have a charge-transporting property.

An anisotropic conductive layer may be formed on the substrate having the charge-transporting property. Consequently, since the charges transferred are not spread widely, the thickness of the substrate can be increased.

The substrate having the charge-transporting property can be made of a charge-transferring polymer. Since the polymer is a self-supporting resin, a strong structure capable of enduring an external force given by bending or elongation can be provided.

Spacer particles having a diameter larger than the particles may be interposed between the substrates, whereby the distance between the substrates can be maintained approximately constant.

According to another aspect of the invention, the gap between the substrates can have a cell structure partitioned in a predetermined shape, whereby the distance between the substrates can be maintained approximately constant and partial imbalance of particles interposed between the substrates can be controlled to allow more stable image display.

According to another aspect of the invention, the conductive particles may be encapsulated in the cells according to plural colors forming a multicolor image. For example, conductive yellow particles and white particles, conductive magenta particles and white particles, and conductive cyan particles and white particles are encapsulated in the respective cells. The color image can be formed by generating the electric field according to each color.

According to another aspect of the invention, there is provided an image-forming apparatus for forming an image on an image display medium including a pair of substrates at least one of which has a charge-transporting property and plural types of particle groups which are interposed movably by an electric field applied from outside and which are different in color and properties, the image-forming apparatus including a latent image carrier, an electrostatic latent image forming unit for forming an electrostatic latent image adapted to the image on the latent image carrier, and a counter electrode for generating an electric field between it and the latent image carrier, the counter electrode being mounted in a position facing the latent image carrier such that the image display medium can be positioned therebetween.

In this case, the electrostatic latent image forming unit forms the electrostatic latent image adapted to the image on the latent image carrier. The counter electrode is mounted facing the latent image carrier such that the image display medium can be positioned therebetween. That is, the electric. field can be generated between the electrostatic latent image on the electrostatic latent image carrier and the counter electrode. Consequently, the particle groups interposed between the substrates can be moved by the electric field generated according to the image to form the image on the image display medium.

The electrostatic latent image forming unit may be so adapted that the latent image carrier is scanned with light beam adapted to the image to form the latent image adapted to the image on the latent image carrier. Further, the latent image carrier may be irradiated with ions generated by the ion-generating unit according to the image to form the electrostatic latent image adapted to the image on the latent image carrier. Still further, the electrostatic latent image adapted to the image may be formed on the latent image carrier by applying a high voltage to the stylus electrode to generate charge adapted to the image.

According to another aspect of the invention, a bias voltage is applied to the counter electrode, whereby an electric field can be generated in the opposite direction between the latent image carrier and the counter electrode. Therefore, for example, the particles adhered to the substrate on the counter electrode side can be moved to the substrate on the latent image carrier side, and the particles adhered to the substrate on the latent image carrier side to the substrate on the counter electrode side respectively.

According to another aspect of the invention, the apparatus has further a charging unit for previously charging the conductive particles.

In this case, the conductive particles can satisfactorily be moved between the substrates by previously charging the particles with the charging unit to display the image stably.

In the charging unit, at least one of a DC voltage and an AC voltage is applied to the substrates. When the DC voltage is applied to the substrates, the conductive particles can uniformly be adhered to one of the substrates. Thus, there is no need to apply bias to the counter electrode. Further, when the AC voltage is applied, the particles can satisfactorily be charged.

According to another aspect of the invention, it is also possible that the charging unit is made of an elastic material and at least one of a DC voltage and an AC voltage is applied to the substrates in a state closely adhered to the image display medium. Consequently, charges can be transferred well to the substrates to satisfactorily charge the particles.

According to another aspect of the invention, the substrate having a charge-transporting property is earthed before conducting the charging by the charging unit.

In this case, since the substrate having the charge-transporting property is earthed before conducting the charging by the charging unit, excess charges, when remaining in the particles, can be removed. Accordingly, it is possible to avoid strong adhesion of the particles to the substrate surface owing to excess charging and to apply stable charges to the particles.

According to another aspect of the invention, there is provided the image-forming apparatus which further includes an inputting unit for inputting whether the medium on which the image is formed is the image display medium or an image-recording medium, a developing unit for developing the electrostatic latent image formed by the electrostatic latent image forming unit with a toner when the result inputted by the inputting unit is the image-recording medium, a transferring unit for transferring the toner image developed by the developing unit onto the image-recording medium, and a fixing unit for fixing the toner image transferred onto the image-recording medium.

In this case, the inputting unit is for inputting whether the medium on which the image is formed is the image display medium or the image-recording medium, namely, ordinary recording paper. For example, a keyboard or a mouse can be used. Users can select the medium by this inputting unit. Further, the inputting unit may be a medium-detecting unit for detecting whether the medium on which the image is formed is the image display medium or the image-recording medium. In this instance, it is possible to detect which the medium is from an amount of reflected light by irradiating the medium with light. Moreover, it is also possible to detect which the medium is by detecting the weight.

In the developing unit, the electrostatic latent image formed by the electrostatic latent image forming unit is developed with the toner when the result inputted by the inputting unit is the image-recording medium, namely, ordinary recording paper. In the transferring unit, the toner image developed with the developing unit is transferred by applying, for example, a voltage to the image-recording medium. In the fixing unit, the toner image transferred onto the image-recording medium is fixed through, for example, heat fixing or pressure fixing.

The transferring unit may be a counter electrode. That is, the image formation of the image display medium and the image formation of the image-recording medium can be conducted with the same transferring unit, whereby the apparatus can be simplified and the costs can be reduced.

When the medium is the image display medium, the fixing treatment is dispensed with. Thus, according to another aspect of the invention, it is also possible that when the result inputted by the inputting unit is the image display medium, the fixing treatment by the fixing unit is not conducted. Consequently, the deterioration of the image display medium owing to heat can be prevented.

According to another aspect of the invention, the apparatus has further a development-stopping unit for stopping the development by the developing unit when the result inputted by the inputting unit is the image display medium.

In this case, the development-stopping unit stops the development when the result inputted by the inputting unit is the image display medium because there is no need to operate the developing unit. Further, when the developing unit is in an operable state, the toner on the electrostatic latent image carrier is supplied, and the image display medium is sometimes contaminated with the toner. Accordingly, when the development with the developing unit is stopped, the adhesion of the toner to the image display medium can be prevented.

In the development-stopping unit, the developing unit may be spaced apart from the latent image carrier, whereby the supply of the toner to the electrostatic latent image carrier can be prevented. Further, the rotation of the toner carrier included in the developing unit may be stopped. Still further, a voltage of reverse polarity to the potential of the electrostatic latent image may be applied to the toner carrier included in the developing unit. Furthermore, the supply of the toner to the toner carrier included in the developing unit may be stopped.

According to another aspect of the invention, the image display medium is initialized.

In this case, the image display medium is initialized, for example, the particles interposed between the substrates are charged before conducting the image formation. For example, a DC voltage, an AC voltage or a voltage obtained by superposing a DC voltage and an AC voltage is applied to the substrates. When the DC voltage is applied to the substrates, the conductive particles can uniformly be adhered to one of the substrates. Further, when the AC voltage is applied, the particles can satisfactorily be charged. Still further, the AC voltage and then the DC voltage may be applied. Consequently, the particles can satisfactorily be charged and the conductive particles be adhered to one of the substrates uniformly.

BRIEF DESCRIPTION OF THE DRAWINGS

Preferred embodiments of the present invention will be described in detail based on the following figures, wherein.

DESCRIPTION OF THE PREFERRED EMBODIMENTS

First Embodiment

Figure 1:
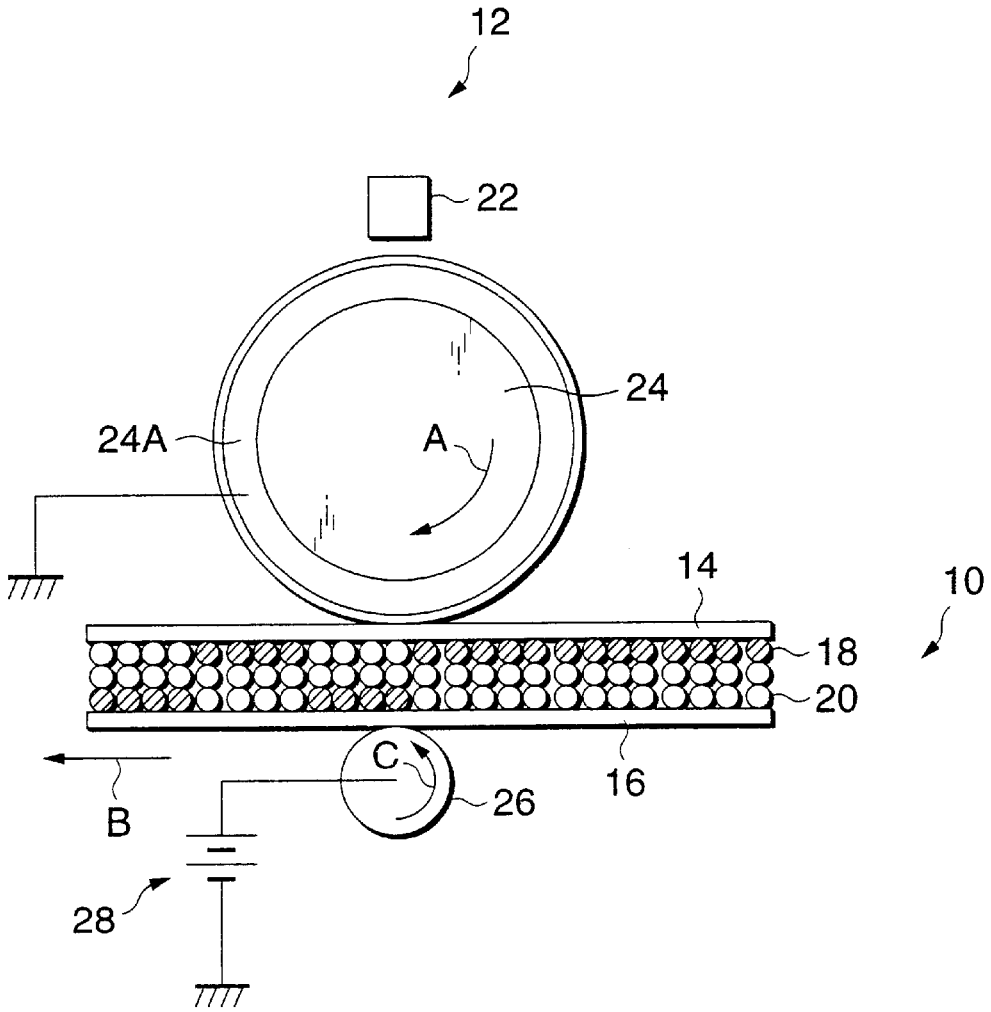
FIG. 1 is a schematic view of an image-forming apparatus according to the first embodiment.

The first embodiment of the invention is described in detail below by referring to the drawings.

FIG. 1 shows an image display medium 10 and an image-forming apparatus 12 for forming an image on the image display medium 10 according to this embodiment.

The image display medium 10 is so adapted that conductive particles 18 and insulating particles 20 which are different from each other in color are interposed between the display substrate 14 on which the image is displayed and the non-display substrate 16 facing the display substrate 14. Further, the display substrate 14 and the non-display substrate 16 are made of a member containing a hole-transferring material or an electron-transferring material and have a charge-transporting property by which to transfer positive or negative charges. Incidentally, one of the substrates may have a charge-transporting property.

Examples of the hole-transferring material include a hydrazone compound, a stilbene compound, a pyrazoline compound and an arylamine compound. A resin containing the same can be used in the substrates. Further, examples of the electron-transferring material include a fluorenone compound, diphenoquinone derivatives, a pyrane compound and zinc oxide. A resin containing the same can be used in the substrates.

Moreover, a self-supporting resin having a charge-transporting property may be used in the substrates. Consequently, a strong structure that withstands an external force exerted on the image display medium 10 by bending or elongation can be provided.

As the self-supporting resin having the charge-transporting property, there is a charge-transferring polymer. Examples thereof include polyvinylcarbazole, a polycarbonate obtained by polymerization of specific dihydroxyarylamine and bischloroformate as described in U.S. Pat. No. 4,806,443, a polycarbonate obtained by polymerization of specific dihydroxyarylamine and phosgene as described in U.S. Pat. No. 4,806,444, a polycarbonate obtained by polymerization of bishydroxyalkylarylamine and bischloroformate or phosgene as described in U.S. Pat. No. 4,801,517, a polycarbonate obtained by polymerization of specific dihydroxyarylamine or bishydroxyalkylarylamine and bischloroformate or a polyester obtained by polymerization with bisacyl halide as described in U.S. Pat. Nos. 4,937,165 and 4,959,288, a polycarbonate or a polyester of arylamine having a specific fluorenone skeleton as described in U.S. Pat. No. 5,034,296, a polyurethane described in U.S. Pat. No. 4,983,482, a polyester having specific bisstylylbisarylamine as a main chain as described in Japanese Patent Publication No. 28,903/1984, a polymer having, as a pendant, a charge-transferring substituent such as hydrazone or triarylamine as described in Japanese Patent Laid-Open Nos. 20,953/1986, 134,456/1989, 134,457/1989, 134,462/1989, 133,065/1992 and 133,066/1992, and a polymer having a tetraarylbenzidine skeleton as reported in The Sixth International Congress on Advances in Non-impact Printing Technologies, 306, (1990) N.

Further, a charge-transferring polymer represented by formula (I-1) or (I-2) as described in, for example, Japanese Patent Laid-Open No. 253,568/1996 can be used. [wherein Y represents a divalent hydrocarbon group, Z represents a divalent hydrocarbon group, A represents a group represented by formula (I-3) (in which $R_1$ and $R_2$, independently from each other, represent a hydrogen atom, an alkyl group, an alkoxy group, a substituted amino group or a halogen atom, X represents a substituted or unsubstituted divalent aromatic group, n is an integer of 1 to 5, and k is 0 or 1) B and B', independently from each other, represent —O—(Y—O)$_m$—H or —O—(Y—O)$_m$—CO—Z—CO—OR' (in which R' represents a hydrogen atom, an alkyl group, a substituted or unsubstituted aryl group, or a substituted or unsubstituted aralkyl group, Y represents a divalent hydrocarbon group, Z represents a divalent hydrocarbon group, and m represents an integer of 1 to 5), m is an integer of 1 to 5, and p is an integer of 5 to 5,000.] Moreover, a charge-transferring polymer of formula (I-1) or (I-2) in which X is represented by structural formula (II) or (III) is also available.

(1-1)

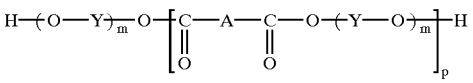

(1-2)

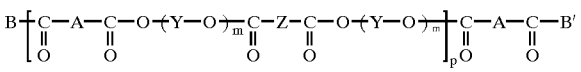

(1-3)

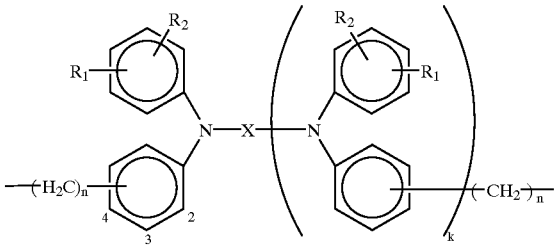

(II)

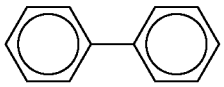

(III)

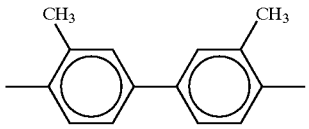

In the conductive particles 18, charges can be transferred by the contact with the substrates. Examples of such particles include particles of carbon black and metals such as nickel, silver, gold and tin, and particles obtained by coating these materials on the surfaces of the particles. Specific examples thereof include spherical conductive particles (Micropearl NI made by Sekisui Chemical Co., Ltd.) obtained by applying electroless nickel plating to surfaces of fine particles made of a crosslinked copolymer containing divinylbenzene as a main component, spherical conductive particles (Micropearl AU made by Sekisui Chemical Co., Ltd.) obtained by further applying gold substitution plating thereto, amorphous carbon spherical conductive particles (Univeks GCP, H-Type made by Unitika Ltd.: volume resistivity $\leqq 10^{-2}\Omega\cdot$cm) obtained by burning a thermosetting phenolic resin through carbonization, spherical conductive particles (Univeks GCP made by Unitika Ltd.: volume resistivity $\leqq 10^{-4}\Omega\cdot$cm) obtained by further surface-coating metal such as gold or silver, spherical conductive particles (Admafine made by Admatechs Co., Ltd.) obtained by coating Ag and tin oxide on surfaces of spherical oxide fine particles of silica and alumina, and particles obtained by adhering or embedding a conductive fine powder to or in surfaces of main particles made of various materials such as a styrene resin, an acrylic resin, a phenolic resin, a silicone resin, a polyester resin and glass. Particles having different colors such as color particles of cyan, magenta, yellow, red, green and blue, and white or black colors are also available. Examples of white or black particles include spherical particles (Micropearl SP, Micropearl BB made by Sekisui Chemical Co., Ltd.) formed of a crosslinked copolymer containing divinylbenzene as a main component, fine particles (MBX-20 Black, White made by Sekisui Plastics CO., Ltd.) of crosslinked polymethyl methacrylate, fine particles of Polytetrafluoro (Rubron L made by Daikin Kogyo Co., Ltd., SST-2 made by Shamrock Technologies Inc.) and silicone resin fine particles (Tospearl made by Toshiba Silicone).

In the following description, the display substrate 14 and the non-display substrate 16 have a charge-transporting property by which to transfer positive charges, the conductive particles 18 are black particles, and the insulating particles 20 are white particles.

The image-forming apparatus 12 has an electrostatic latent image forming portion 22, a drum-like electrostatic latent image carrier 24, a counter electrode 26 and a DC voltage power supply 28.

The electrostatic latent image forming portion 22 is mounted above the electrostatic latent image carrier 24. In the electrostatic latent image forming portion 22, the electrostatic latent image adapted to the image to be recorded on the image display medium 10 is formed on the electrostatic latent image carrier 24. The formation of the electrostatic latent image is conducted such that, for example, the non-image portion is positively charged and the image portion is not charged.

A conductive support 24A of the electrostatic latent image carrier 24 is earthed. Further, the electrostatic latent image carrier 14 is turned in the arrow A direction.

Figure 2:
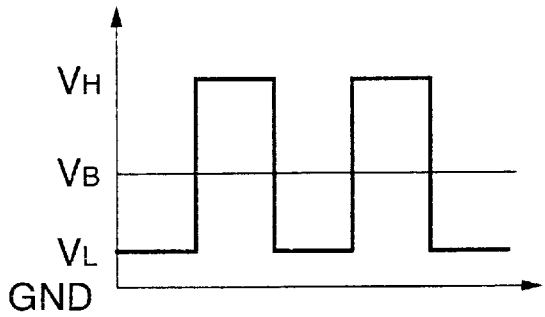
FIG. 2 is a view showing a potential in an electrostatic latent image carrier and a counter electrode.

The counter electrode 26 is constructed of, for example, an elastic conductive roll member. Accordingly, it can closely be adhered to the image display medium 10. Further, the counter electrode 26 is mounted facing the electrostatic latent image carrier 24 such that the image display medium 10 transported in the arrow B direction by a transporting unit not shown is held therebetween. The counter electrode 26 is connected to the DC voltage power supply 28. A bias voltage $V_B$ is applied to the counter electrode 26 by this DC voltage power supply 28. The bias voltage $V_B$ to be applied is, as shown in, for example, FIG. 2, a voltage that reaches an intermediate potential between a potential $V_H$ of a positively charged portion of the electrostatic latent image carrier 24 and a potential $V_L$ of an uncharged portion. Moreover, the counter electrode 26 is turned in the arrow C direction in FIG. 1.

The function of the first embodiment is described below.

When the electrostatic latent image carrier 24 starts turning in the arrow A direction, the electrostatic latent image is formed on the electrostatic latent image carrier 24 by the electrostatic latent image forming portion 22.

Meanwhile, the image display medium 10 is transported in the arrow B direction by the transporting unit not shown, and sent between the electrostatic latent image carrier 24 and the counter electrode 26.

Figure 3:
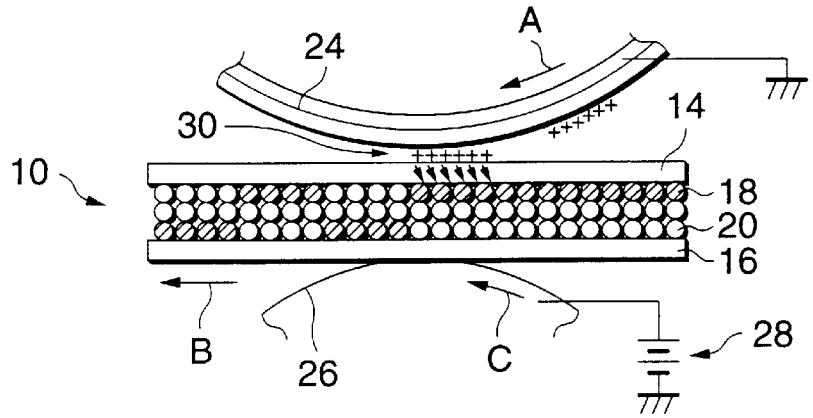
FIG. 3 is a partially enlarged view of the image-forming apparatus.

As shown in FIG. 3, when the portion of the electrostatic latent image carrier 24 which is facing the display substrate 14 is positively charged (non-image portion) and the conductive particles 18 are adhered to the portion of the display substrate 14 which is facing the electrostatic latent image carrier 24, positive charges (non-image portion) 30 on the electrostatic latent image carrier 24 are transferred to the display substrate 14 to charge the conductive particles 18.

The bias voltage $V_B$ is applied to the counter electrode 26, and the potential of the electrostatic latent image carrier 24 facing the counter electrode 26 is $V_H$. Accordingly, the charged conductive particles 18 are moved from the display substrate 14 to the non-display substrate 16, and adhered to the non-display substrate 16. Consequently, the insulating white particles 20 alone appear on the display substrate 14, so that the image is not displayed on the portion corresponding to the non-image portion.

Figure 4:
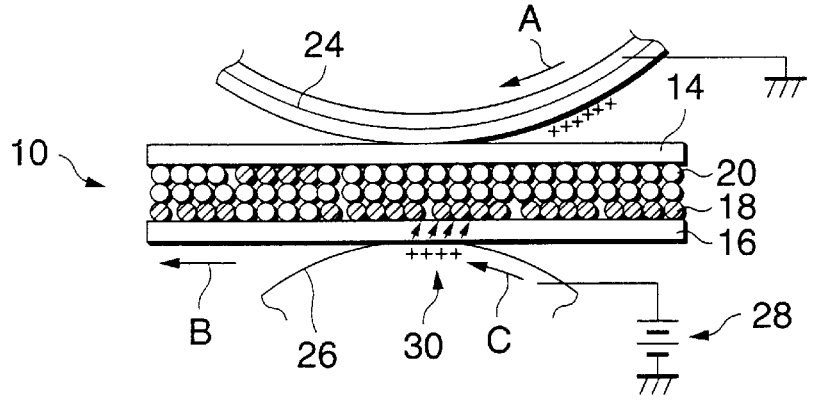
FIG. 4 is a partially enlarged view of the image-forming apparatus.

On the other hand, as shown in FIG. 4, when the portion of the electrostatic latent image carrier 24 which is facing the display substrate 14 is not positively charged (image portion) and the conductive particles 18 are adhered to the portion of the non-display substrate 16 which is facing the counter electrode 26, the positive charges 30 supplied from the counter electrode 26 are transferred to the non-display substrate 16 to charge the conductive particles 18.

In this case, the bias voltage $V_B$ is applied to the counter electrode 26, and the potential of the electrostatic latent image carrier 24 facing the counter electrode 26 is $V_L$. Accordingly, the charged conductive particles 18 are moved from the non-display substrate 16 to the display substrate 14, and adhered to the display substrate 14. Consequently, since the conductive black particles 18 alone appear on the display substrate 14, the image is displayed on the portion corresponding to the image portion.

In this manner, the conductive particles 18 are moved according to the image, and the image is displayed on the display substrate 14. Even after the electric field generated between the substrates of the image display medium 10 is lost, the image displayed is maintained by the adhesion inherent in the conductive particles and the image force between the particles and the substrates. Further, when the electric field is generated between the substrates, the conductive particles 18 can be moved again. Therefore, the image can repetitively be displayed by the image-forming apparatus 12.

Thus, the bias voltage is applied to the counter electrode 26, so that the conductive particles 18 can be moved even when the conductive particles 18 are adhered to either the display substrate 14 or the non-display substrate 16. Accordingly, there is no need to previously adhere the conductive particles 18 to one substrate. Further, the image with the high contrast and the high sharpness can be formed. Still further, since the charged particles are moved by the electric field using air as a medium, the safety is high. Furthermore, since air has a low viscosity resistance, the high-speed response can be satisfied.

Figure 5:
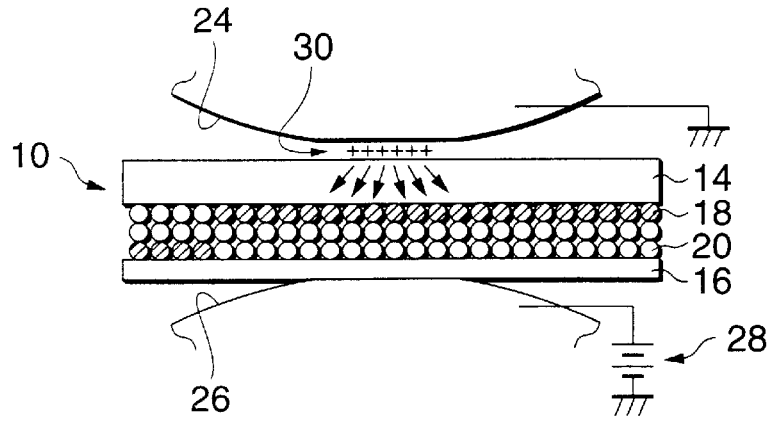
FIG. 5 is a view illustrating an anisotropic conductive layer.

An anisotropic conductive layer may be formed on at least one side of the image display medium 10. Since the image display medium 10 is treated as a sheet, some rigidity is required. There is a method in which the thickness of the substrate is increased to secure the rigidity. However, when the thickness of the substrate is increased, the positive charges 30 are spread widely in the surface direction when passed through the substrate as shown in FIG. 5, and the image of high resolution is hardly displayed. Meanwhile, in the anisotropic conductive layer, the charges flow in one direction alone. Therefore, even when the thickness of the substrate is increased, the charges are not spread widely, and the image of high resolution can be formed. Accordingly, the rigidity of the image display medium can be secured, without inviting the decrease in resolution, by forming an anisotropic conductive layer having an appropriate thickness on at least one of the opposite substrates of the image display medium.

Figure 6:
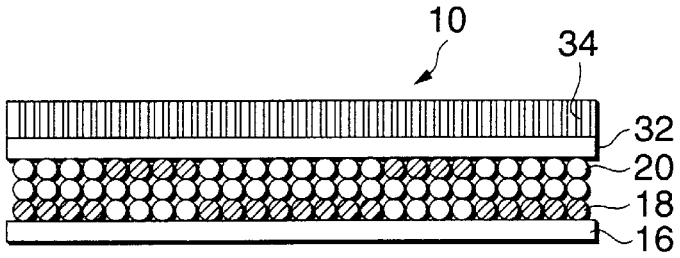
FIG. 6 is a view illustrating the anisotropic conductive layer.
Figure 7:
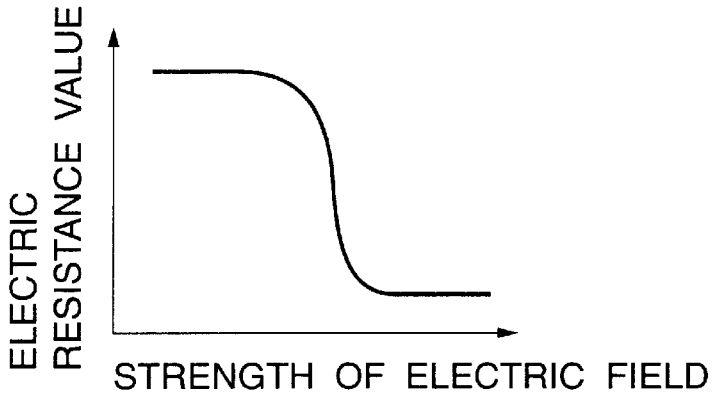
FIG. 7 is a graph showing a relation of a strength of an electric field and an electric resistance value of the anisotropic conductive layer.
Figure 8:
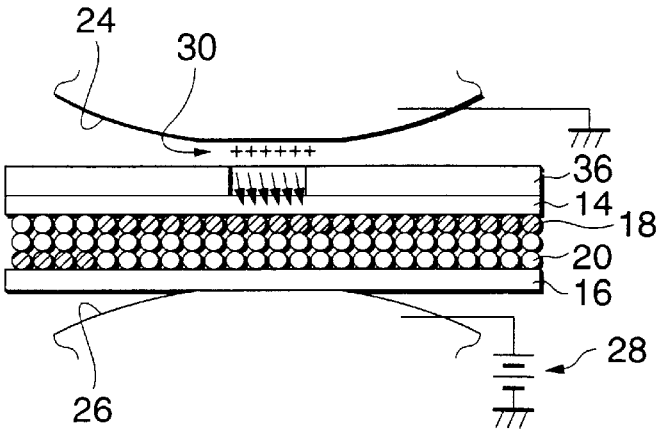
FIG. 8 is a view illustrating the anisotropic conductive layer.

As the anisotropic conductive layer, as shown in FIG. 6, a layer can be used in which conductive pin-like members 34 having a diameter of 10 $\mu$m to 100 $\mu$m are independently embedded in an insulating base material 32 in the thickness direction of the insulating base material 32. Further, a layer can be used in which conductive bar-like fillers having a diameter of 0.1 $\mu$m to 10 $\mu$m are disposed perpendicularly to the surface of the insulating base material using a magnetic force. Upon using these layers, the charges flow in the thickness direction only through the conductive member of the anisotropic conductive layer. Accordingly, even when the thickness of the anisotropic conductive layer is increased, the wide spreading of the charges in transferring the same can be prevented. Moreover, as the anisotropic conductive layer, a semiconducting base material in which the resistance value varies with the strength of the electric field is also available. This shows a high resistance under a low electric field but markedly decreases the resistance under a high electric field as shown in FIG. 7. For example, a material can be used in which an electric resistance is at least $10^{14}$ Ω·cm in the absence of the electric field and at most $10^4$ Ω·cm under the electric field of $10^5$ V/m to $10^7$ V/m. As the semiconducting material, a material obtained by using polyvinyl chloride, polyethylene, polyimide or teflon as a base and dispersing conductive fine particles therein to adjust the resistance is available. The use of the semiconducting material makes it possible to change the electric resistance of the anisotropic conductive layer 36 according to the electric field pattern in which to form the electrostatic latent image as shown in FIG. 8, to decrease the electric resistance in a necessary portion alone and to pass the charges in the thickness direction only.

In addition, a protecting layer may be formed on the surface of the image display medium 10. The surface of the image display medium 10 is liable to damage owing to the repetitive use. When the surface thereof is damaged, not only might the image display quality be decreased, but also the surface of the electrostatic latent image carrier or the conductive roll member in contact with this might be damaged. As the protecting layer, a material which has a high abrasion resistance and in which charges can be moved in the thickness direction is available.

With respect to the electric resistance of the protecting layer, it is advisable that the charges are not spread in the surface direction of the image display medium 10 and can be moved in the thickness direction sufficiently as required. The electric resistance is preferably between $10^{10}$ Ω·cm and $10^{13}$ Ω·cm. Consequently, the abrasion resistance of the image display medium 10 is improved, and the image display medium is hard to damage. Thus, the number of repetitive uses can be increased.

Figure 9:
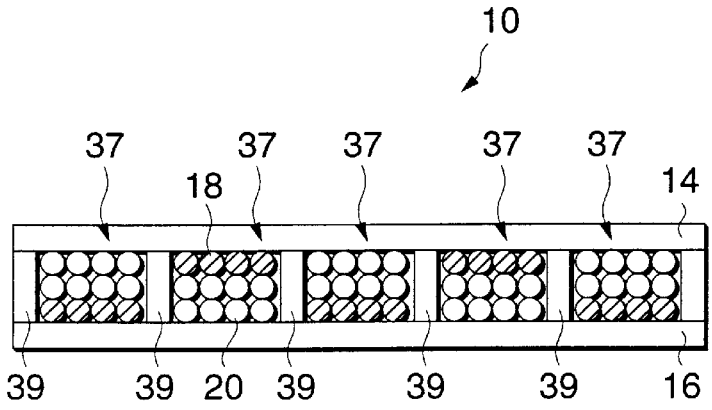
FIG. 9 is a view showing an example of the image display medium.

In the construction of the image display medium 10, it is also possible that as shown in, for example, FIG. 9, a gap between the opposite substrates of the image display medium 10 has a cell structure in which the particles are encapsulated in each cell 37. Consequently, partial imbalance of the particles interposed between the substrates can be suppressed to conduct more stable image display. Further, since the gap between the opposite substrates is constantly controlled by cell walls 39, the image display with the electrostatic force can be conducted more stably. Moreover, it does not occur that when the pressure is applied to the image display medium 10, the image display medium 10 is collapsed and the particles interposed are agglomerated to stop the movement of the particles by the electrostatic force. Thus, the defective display owing to this can be prevented.

The image display medium 10 having the cell structure can be formed by forming a cell pattern of an optional size on at least one of the substrates through etching treatment, laser processing, or press working with a mold produced previously, then encapsulating desired particles in each cell and bonding the opposite substrate thereon.

Figure 10:
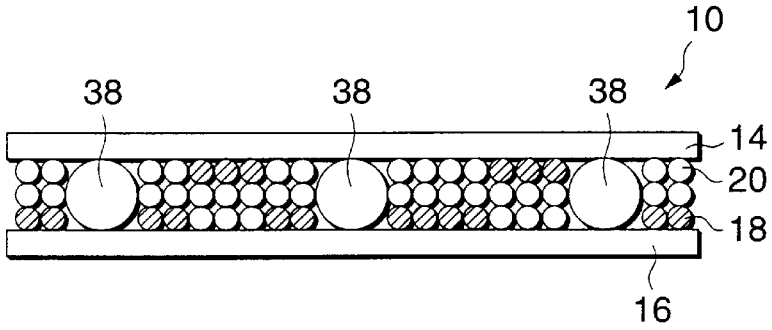
FIG. 10 is a view showing an example of the image display medium.

Besides the cell structure, the gap between the opposite substrates can be controlled by interposing spacer particles 38 having the same size as the desired gap as shown in FIG. 10. This method has no function to prevent partial imbalance of the particles, but it can provide the image display medium 10 much more easily and inexpensively than the formation of the cell structure. As the spacer particles, transparent particles that less influence the display image can preferably be used. For example, glass particles and polystyrene, polyester or acrylic transparent resin particles are available.

Moreover, in this embodiment, the description has been given on condition that the positively charged portion of the electrostatic latent image carrier 24 is the non-image portion while the uncharged portion is the image portion, and the conductive particles are black particles while the insulating particles are white particles. However, this is not critical. It is also possible that the positively charged portion on the electrostatic latent image carrier 24 is an image portion while the uncharged portion is a non-image portion, and the conductive particles are white particles while the insulating particles are black particles. Further, the image may be formed such that the image display medium is formed using a substrate having an electron-transporting property, not the charge-transporting property, the non-display substrate 16 is mounted on the electrostatic latent image carrier 24, or the polarities of the image portion and the non-image portion on the electrostatic latent image carrier 24 and the polarities of the particles are combined as required.

Second Embodiment

The second embodiment is described below by referring to the drawings. By the way, the same portions as in the image-forming apparatus 12 described in the first embodiment are given the same numerals, and the detailed description thereof is omitted.

Figure 15:
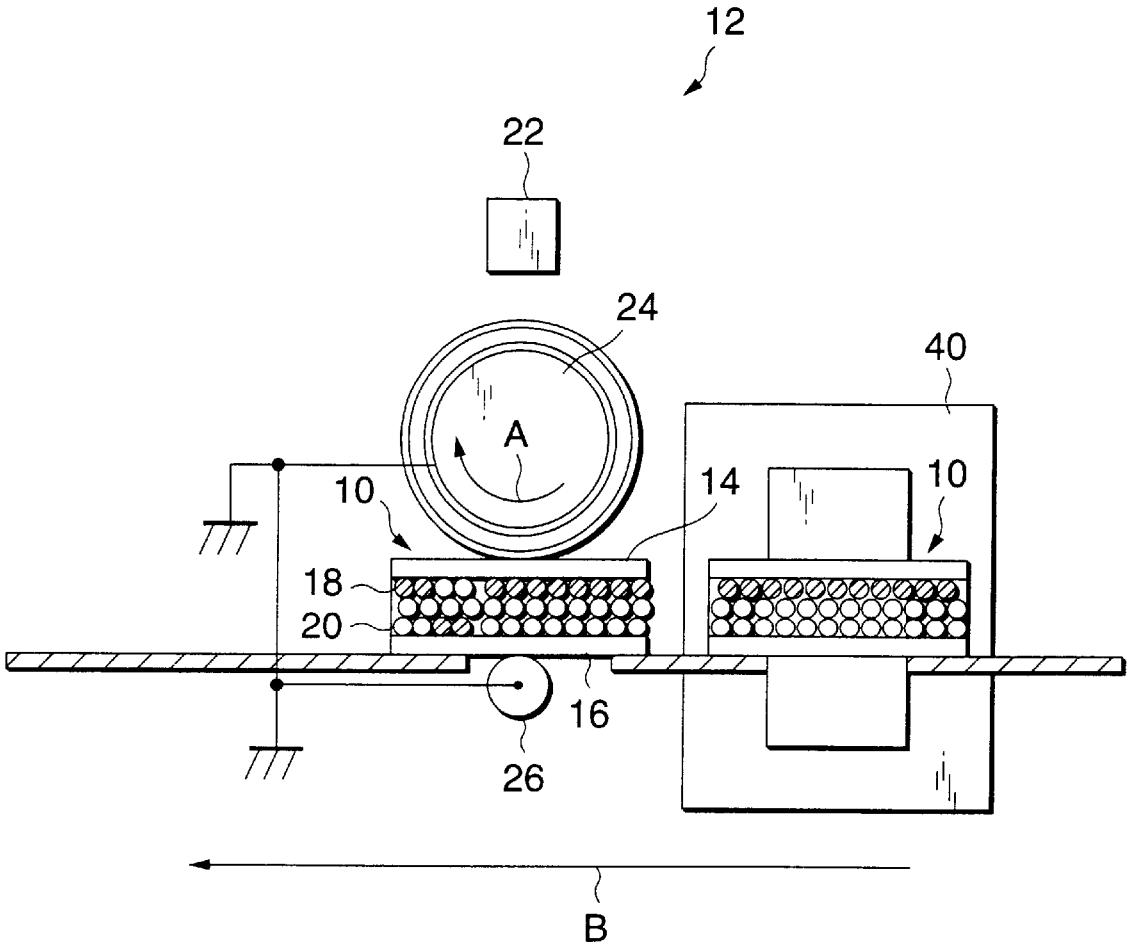
FIG. 15 is a schematic view of the image-forming apparatus according to the second embodiment.

In the image-forming apparatus 12 shown in FIG. 15, the electrostatic latent image carrier 24 and the counter electrode 26 are both grounded. Further, an initializer 40 for charging the conductive particles 18 of the image display medium 10 and uniformly adhering the conductive particles 18 to the display substrate 14 is provided.

Figure 11:
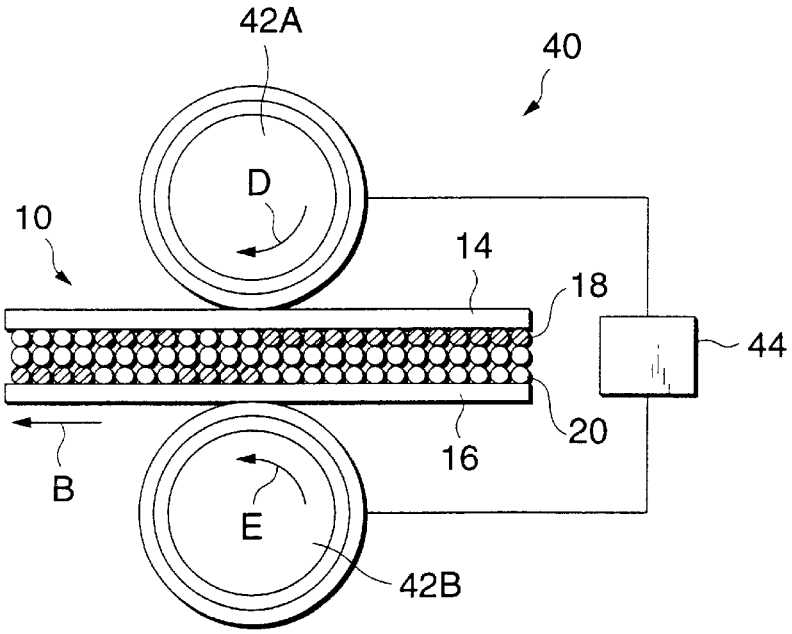
FIG. 11 is a schematic view of an initializer.

The initializer 40 shown in FIG. 11 has a pair of conductive roll members 42 and a power supply 44 for applying a voltage to the conductive roll members 42. The conductive roll member 42A is turned in the arrow D direction and the conductive roll member 42B in the arrow E direction respectively.

Figure 12:
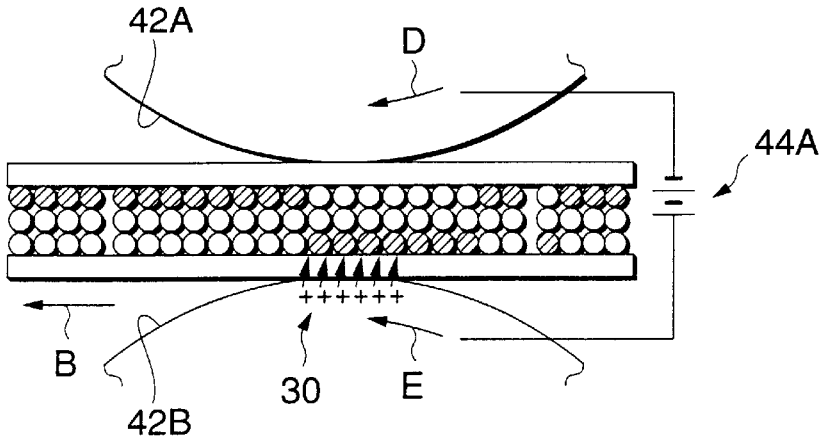
FIG. 12 is a partially enlarged view of the initializer.

The power supply 44 applies a DC voltage to the conductive roll member 42 as shown in, for example, FIG. 12. In the example shown in FIG. 12, the conductive roll member 42B is positive. In the initializer 40 having this construction, the image display medium 10 is transported by a transporting unit not shown in the arrow B direction. When the image display medium is sent to a position where the conductive roll member 42A and the conductive roll member 42B are facing each other, the application of the DC voltage is started by the power supply 44.

As shown in FIG. 12, the positive charges 30 supplied from the conductive roll member 42B by the DC voltage applied are transferred to the non-display substrate 16 having the charge-transporting property to charge the conductive particles 18 adhered to the image display medium 10. The charged conductive particles 18 are moved to the display substrate 14 having a low potential, and adhered to the display substrate 14. Further, negative charges are generated on the side of the conductive roll member 42A. However, since the display substrate 14 has no negative-charge-transporting property, the conductive particles 18 adhered to the display substrate 14 are not negatively charged. Therefore, the conductive particles 18 adhered to the display substrate 14 are not moved toward the non-display substrate 16. The conductive particles 18 originally adhered to the display substrate 14 remain adhered to the display substrate 14 without being charged, and are not moved toward the non-display substrate 16. That is, the conductive particles 18 can uniformly be adhered to the display substrate 14 by applying the DC voltage to the conductive roll members 42.

Figure 13:
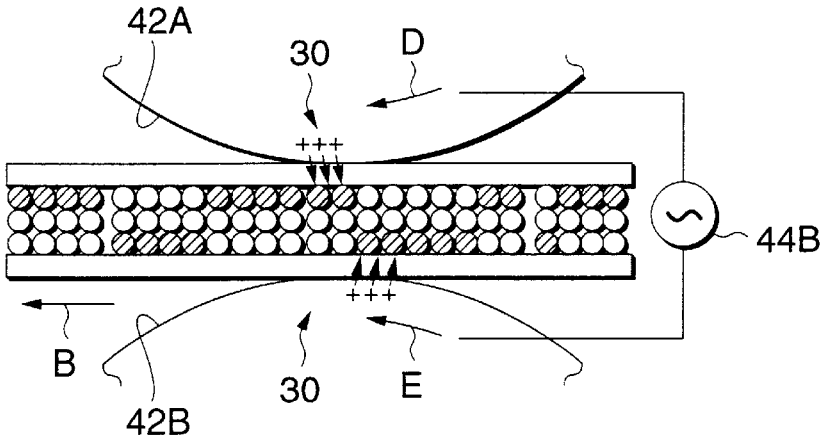
FIG. 13 is a partially enlarged view of the initializer.

As shown in FIG. 13, the power supply 44 may apply an AC voltage to the conductive roll members 42. When the AC voltage is applied in this manner, the positive charges 30 supplied from the conductive roll members 42 are transferred to the display substrate 14 or the non-display substrate 16 to charge the conductive particles 18, whether the conductive particles 18 are adhered to the display substrate 14 or to the non-display substrate 16 as shown in FIG. 13. Incidentally, it is advisable that the time for applying the AC voltage to the image display medium 10 is longer than at least one period of the AC voltage to be applied. This makes it possible to charge all of the conductive particles 18. Accordingly, in consideration of the same, the time for which the image display medium 10 passes through the initializer 40, namely, a rate of transportation and a frequency of the AC voltage are determined.

After the AC voltage is applied to the image display medium 10, the DC voltage may be applied thereto, whereby all of the conductive particles 18 can be charged and uniformly adhered to the display substrate 14.

Thus, there are the case of charging the particles by applying the DC voltage and the case of charging the particles by applying the AC voltage. However, in the case of charging the particles by applying the DC voltage, the charges cannot satisfactorily be applied to the particles. Accordingly, the particles are satisfactorily charged by the charge injection using the electric field of the electrostatic latent image to enable the movement thereof between the substrate.

Further, in the case of charging the particles by applying the AC voltage, the charges can satisfactorily be applied to the particles. Accordingly, the particles can be moved according to the electric field between the electrostatic latent image and the counter electrode. When the particles are satisfactorily charged, the rate of movement of the particles by the electric field is higher than the rate of the charge injection. Thus, the movement of the particles charged is dominated.

In the foregoing description, the conductive roll members 42 are used as the voltage applying members in the initializer 40. However, any known voltage-applying members can be used so long as the charges can be transferred to the conductive particles 18 through the substrate having the charge-transporting property in the image display medium 10 to charge the conductive particles 18. For example, a conductive brush can be used as a contact-type voltage-applying member and a corotron or a stylus electrode as a non-contact-type voltage-applying member.

When the conductive roll members 42 are used, it is important that the conductive roll members 42 are surely adhered closely to the image display medium 10 for surely and stably conducting the charge transfer from the conductive roll members 42 to the substrates. It is advisable that the conductive roll members 42 are elastic. For example, a metallic roll coated with a polyurethane rubber of which the electric resistance is controlled to between $10^6$ and $10^8$ Ω as an elastic layer can be used.

Figure 14:
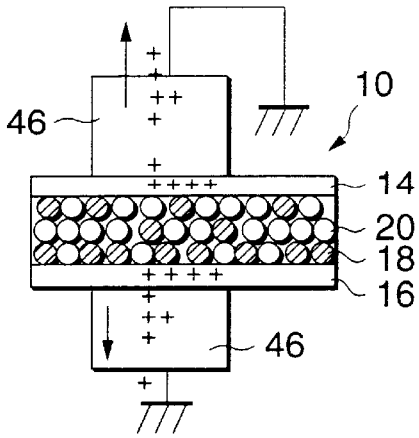
FIG. 14 is a view showing a static eliminator member.

Prior to the charging by the initializer 40, it is recommendable that as shown in FIG. 14, the display substrate 14 and the non-display substrate 16 are earthed with a static eliminator member 46 to cause excess charges present in the conductive particles 18, the display substrate 14 and the non-display substrate 16 to flow in the earthed surface. This step makes it possible to avoid the strong adhesion of the particles on the substrate surfaces owing to the excess charging and to apply stable charges to the particles.

The function of the second embodiment is described below.

In the initializer 40 according to this embodiment, the DC voltage shown in FIG. 12 is applied to the conductive roll members 42. Further, it is also possible that after the AC voltage is applied, then the DC voltage is applied.

The image display medium 10 is transported by a transporting unit not shown in the arrow B direction, and sent to a position where the conductive roll member 42A and the conductive roll member 42B of the initializer 40 are facing each other. Then, the application of the DC voltage is started by the power supply 44.

As shown in FIG. 12, the positive charges 30 supplied from the conductive roll member 42B by the DC voltage applied are passed through the non-display substrate 16 having the charge-transporting property to charge the conductive particles 18 adhered to the image display medium 10. The charged conductive particles 18 are moved toward the display substrate 14 having a low voltage, and adhered to the display substrate 14. Further, negative charges are generated on the side of the conductive roll member 42A. However, since the display substrate 14 has no negative charge-transporting property, the conductive particles 18 adhered to the display substrate 14 are not negatively charged. Accordingly, the conductive particles 18 adhered to the display substrate 14 are not moved toward to the non-display substrate 16. The conductive particles 18 originally adhered to the display substrate 14 remain adhered to the display substrate 14 without being charged, and are not moved toward the non-display substrate 16. Accordingly, the conductive particles 18 can uniformly be adhered to the display substrate 14.

Then, when the electrostatic latent image carrier 24 starts turning in the arrow A direction, the electrostatic latent image is formed on the electrostatic latent image carrier 24 by the electrostatic latent image forming portion 22.

Meanwhile, the image display medium 10 is transported by the transporting unit not shown in the arrow B direction, and sent between the electrostatic latent image carrier 24 and the counter electrode 26.

Figure 16:
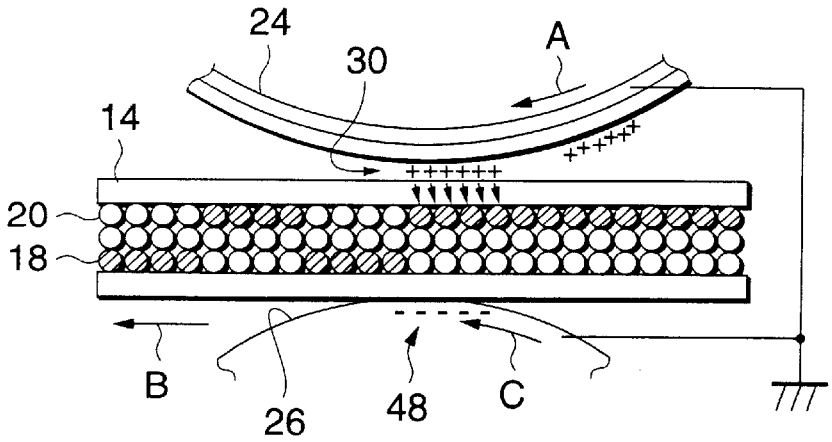
FIG. 16 is a partially enlarged view of the image-forming apparatus.

As shown in FIG. 16, when the portion of the electrostatic latent image carrier 24 which is facing the display substrate 14 is positively charged (non-image portion) and the conductive particles 18 are adhered to the portion of the display substrate 14 which is facing the electrostatic latent image carrier 24, the conductive particles 18 previously charged are moved from the display substrate 14 to the non-display substrate 16 by the electric field formed between the electrostatic latent image and the counter electrode, and are adhered to the non-display substrate 16.

Figure 17:
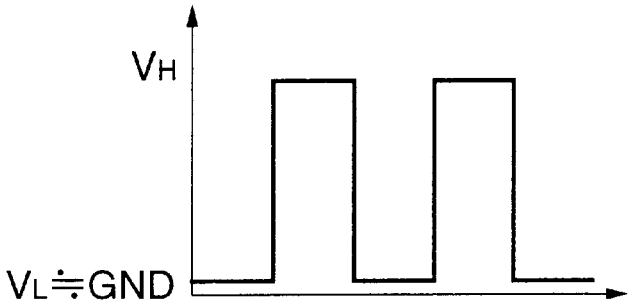
FIG. 17 is a view showing a potential in an electrostatic latent image carrier and a counter electrode.

In this case, the counter electrode 26 is earthed, and the potential of the electrostatic latent image carrier 24 in a position facing the counter electrode 26 is $V_H$ as shown in FIG. 17. Accordingly, the charged conductive particles 18 are moved from the display substrate 14 to the non-display substrate 16, and adhered to the non-display substrate 16. Consequently, since the white insulating particles 20 alone appear on the display substrate 14, the image is not displayed on the portion corresponding to the non-image portion.

Negative charges are induced in the counter electrode 26. However, since the non-display substrate 16 has no negative charge-transporting property, the conductive particles 18 are not negatively charged. Thus, the conductive particles 18 adhered to the non-display substrate 16 are not moved again toward the display substrate 14.

When the portion of the electrostatic latent image carrier 24 which is facing the display substrate 14 is not positively charged (image portion), the potential of this portion is $V_L$ as shown in FIG. 17, and no electric field is generated. Thus, the conductive particles 18 originally adhered to the display substrate 14 are not moved toward the non-display substrate 16.

Consequently, since the conductive black particles 18 alone appear on the display substrate 14, the image is displayed on the portion corresponding to the image portion.

Thus, the conductive particles 18 are moved only from the display substrate 14 to the non-display substrate 16. However, since the conductive particles 18 are previously adhered to the display substrate 14 with the initializer 40, there is no problem.

Even after the electric field generated between the substrates of the image display medium 10 is lost, the image displayed is maintained by the adhesion inherent in the conductive particles and the image force between the particles and the substrates. Further, when the electric field is generated between the substrates, the conductive particles 18 can be moved again. Thus, the image can repetitively be displayed with the image-forming apparatus 12.

Third Embodiment

The third embodiment is described below by referring to the drawings. In the third embodiment, an image-forming apparatus which can form the image on the image display medium 10 capable of repetitive use and also on ordinary recording paper is described.

Figure 18:
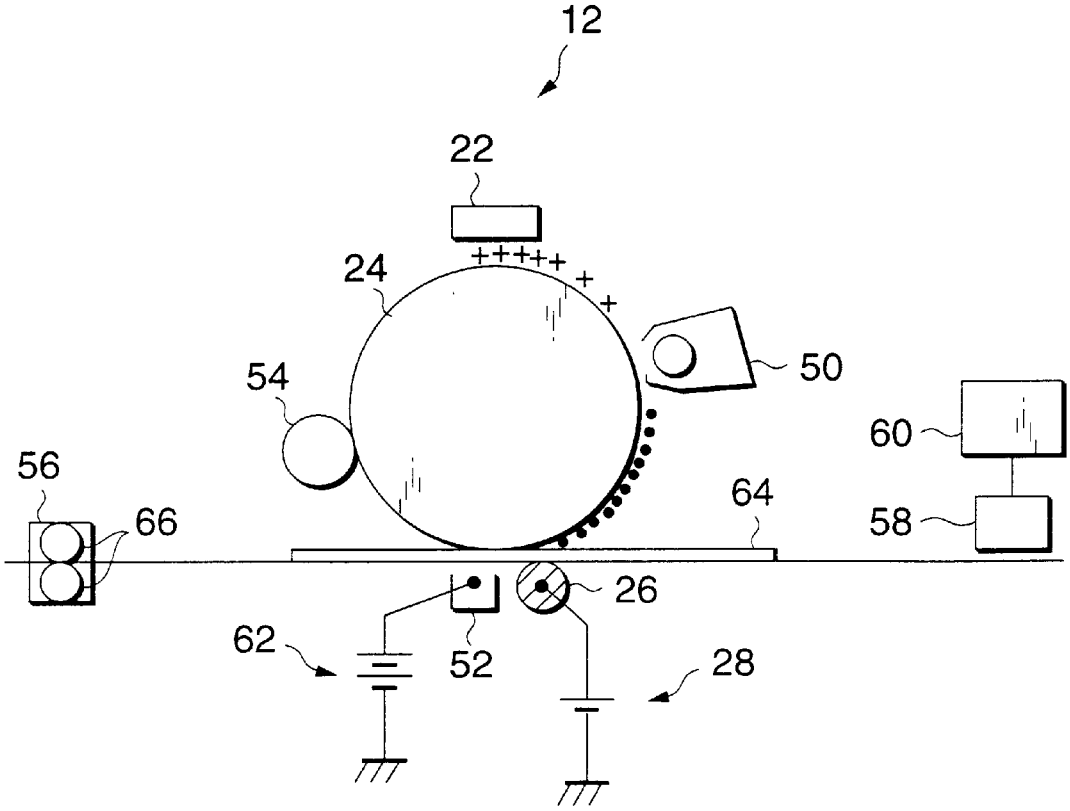
FIG. 18 is a schematic view of the image-forming apparatus according to the third embodiment.

FIG. 18 shows the image-forming apparatus 12 which can form the image on the image display medium 10 and also on ordinary recording paper. By the way, the same portions as in the image-forming apparatus 12 described in the first embodiment are given the same numerals, and the detailed description thereof is omitted.

As shown in FIG. 18, the image-forming apparatus 12 has the developing device 50, the transfer device 52, the cleaning device 54, the fixing device 56, the medium-detecting sensor 58 and the control portion 60.

In the developing device 50, the electrostatic latent image formed on the electrostatic latent image carrier 24 by the electrostatic latent image forming portion 22 is developed with a toner. The image formation of the toner image can be conducted by a method which is generally used in electrophotography. For example, any of a magnetic one-component development method, a non-magnetic one-component development method and a two-component development method using a contact or non-contact developing roll may be employed.

The transfer device 52 is connected to the DC voltage power supply 62. This transfer device 52 transfers the toner image formed on the electrostatic latent image carrier 24 onto recording paper 64 by applying the voltage from the DC voltage power supply 62. As a transfer member, any member that conducts transfer by the electric field, such as a corotron or a roll, may be used.

Figure 19:
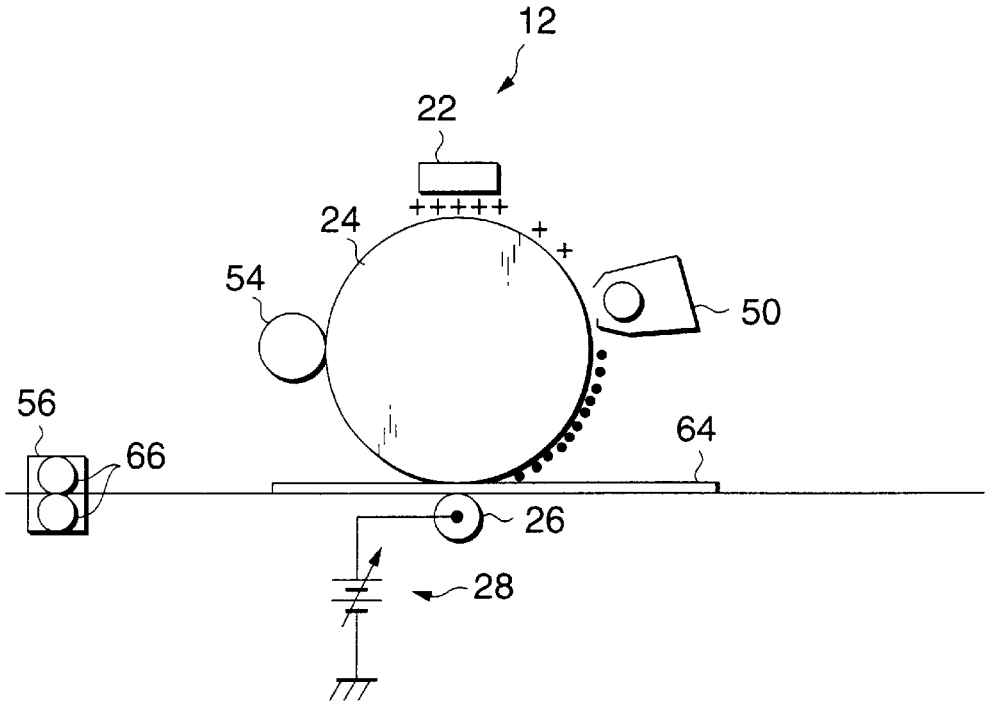
FIG. 19 is a modification example of the image-forming apparatus according to the third embodiment.

Since the transfer of the toner image onto the recording paper 64 and the image formation on the image display medium 10 are both conducted by applying the voltage, the counter electrode 26 may be used in common as the transfer device 52 as shown in FIG. 19. In this case, the DC voltage power supply 28 may be used as a power supply capable of controlling the applied voltage.

The cleaning device 54 removes the toner remaining on the electrostatic latent image carrier 24 after the transfer. As the cleaning member, a brush, a roll or a blade can be used.

The fixing device 56 has a pair of fixing rollers 66 which can be heated at a predetermined temperature. The toner image on the recording paper 64 can be heat-fixed such that the recording paper 64 is transported with the fixing rollers 66 heated by being held therebetween. Further, not only the roller but also a belt is available, and not only the heat-fixing but also the pressure-fixing may be conducted.

Figure 20:
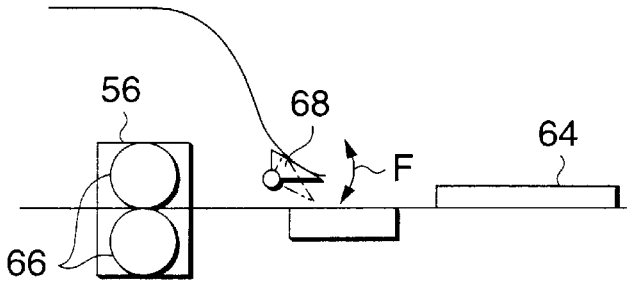
FIG. 20 is a schematic view of a fixing device and a transport route change-over member.

In the image-forming apparatus 12, as shown in FIG. 20, though not shown in FIG. 18, a transport route change-over member 68 is disposed before the fixing device 56 on the medium transport route. This transport route change-over member 68 is turned in the arrow F direction according to instructions from the control portion 60 to change the transport route of the medium. When a medium is the recording paper 64, the tip of the transport route change-over member 68 is raised upward as shown in FIG. 20 according to instructions from the control portion 60, whereby the recording paper 64 is transported toward the fixing device 56. Meanwhile, when the medium is the image display medium 10, the tip is lowered downward as shown by a broken line according to instructions from the control portion 60, whereby the image display medium 10 is transported upward without being passed through the fixing device 56.

Figure 21:
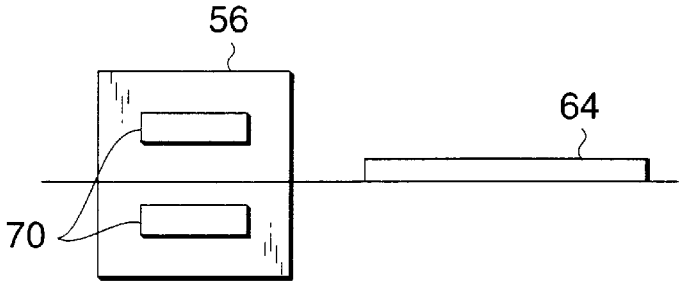
FIG. 21 is a view showing a fixing unit.

It is also possible that the transport route change-over member 68 is not provided but a pair of hot wires 70 which are not contacted with the recording paper 64 and which can change over the heating at high speed are used in the fixing device 56 as shown in FIG. 21. Consequently, when a medium to be transported is the recording paper 64, the hot wires 70 are heated to conduct the fixing treatment, and when the medium is the image display medium 10, the heating of the hot wires 70 is not conducted. Accordingly, the recording paper 64 and the image display medium 10 can be treated with the same transport route. Further, a heat radiation device or an induction heater may be used.

Figure 22:
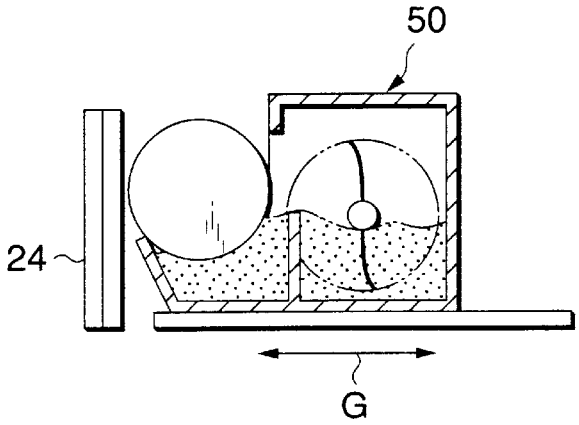
FIG. 22 is a schematic view of a developing device.
Figure 23:
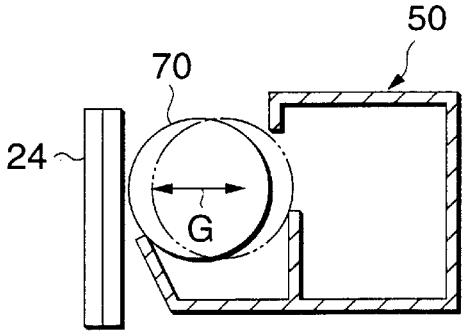
FIG. 23 is a view showing another example of the developing device.

The developing device 50 can be moved, as shown in FIG. 22, in the arrow G direction by instructions from the control portion 60 such that it is separated from, or contacted with, the electrostatic latent image carrier 24. Consequently, in case of conducting the image formation of the image display medium 10 after the image formation onto the recording paper 64, the developing device 50 is separated from the electrostatic latent image carrier 24, and the toner is thus not supplied to the electrostatic latent image carrier 24. Accordingly, the toner can be prevented from being adhered to the image display medium 10. Incidentally, it is also possible to move the developing roll 70 alone (to a position shown by a broken line) as shown in FIG. 23 without moving the whole developing device 50.

Figure 24:
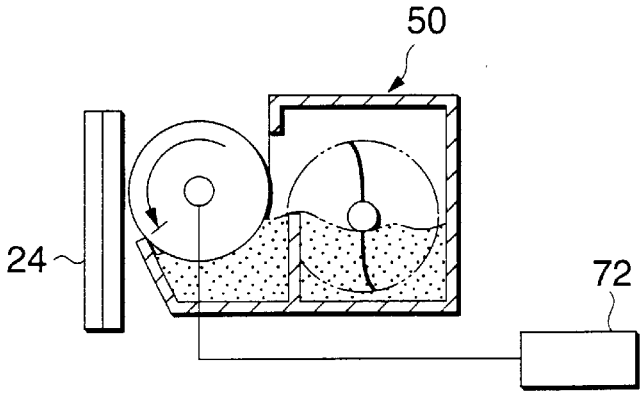
FIG. 24 is a view showing another example of the developing device.
Figure 25:
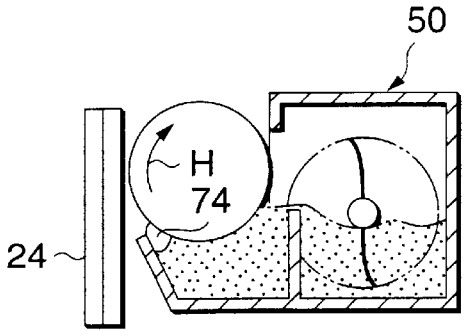
FIG. 25 is a view showing another example of the developing device.
Figure 26:
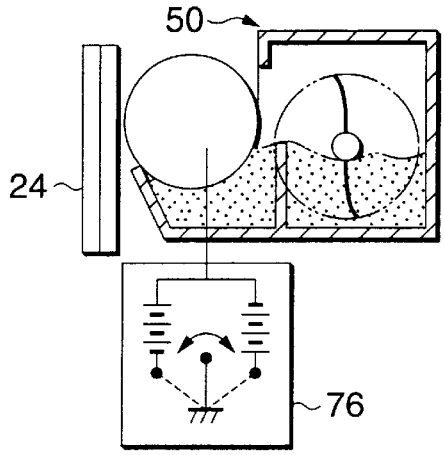
FIG. 26 is a view showing another example of the developing device.

Further, the supply of the toner to the electrostatic latent image carrier 24 may be prevented such that the driving of the developing roll 70 is stopped by a driving device 72 according to instructions from the control portion 60 as shown in FIG. 24, or the developing roll 70 is reversely rotated (in the arrow H direction) and a stop member 74 stops the supply of the toner to the developing roll as shown in FIG. 25, or a voltage of a polarity opposite to a potential of an electrostatic latent image is applied to the developing roll 70 using a voltage-applying device 76 capable of changing over a polarity of a voltage applied as shown in FIG. 26.

A medium-detecting sensor 58 is connected to the control portion 60. In the medium-detecting sensor 58, light reflected by applying predetermined light (for example, infrared light) to, for example, a medium being passed is detected, and an amount of reflected light detected is measured, and outputted to the control portion 60. Further, it is also possible to detect a weight of a medium being passed and output the same to the control portion 60.

In the control portion 60, it is judged whether the medium of forming the image is the image display medium 10 or the recording paper 64 based on the detected result outputted from the medium-detecting sensor 58. Further, the control portion 60 determines the control parameter of each portion according to the medium, controlling each portion according to the control parameter. This control parameter includes, for example, an image-forming parameter, an electric field-generating parameter, an information as to whether the developing device 50 is used or not, an information as to whether the fixing device 56 is used or not, and a medium transport route.

Figure 27:
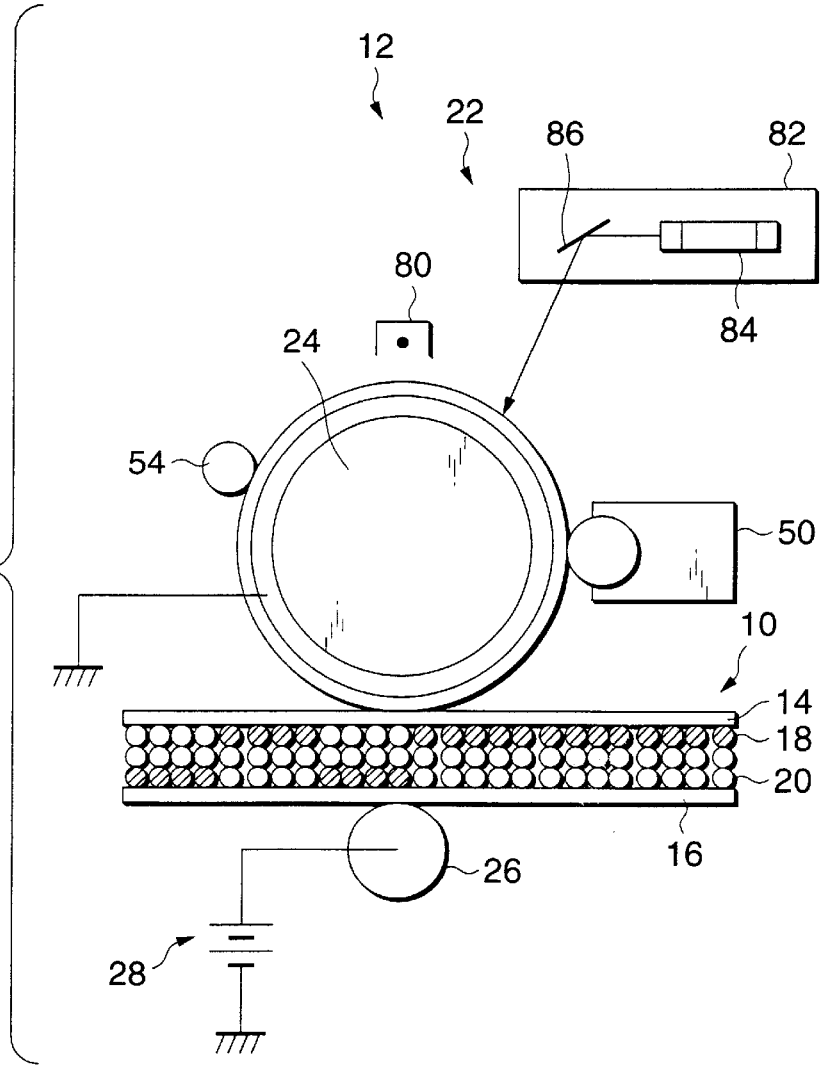
FIG. 27 is a view showing a latent image forming portion.

The construction of the electrostatic latent image forming portion 22 is described below. As shown in FIG. 27, the electrostatic latent image forming portion 22 has a charging device 80 and a light beam scanner 82. In this case, a photoreceptor drum 24 can be used as the electrostatic latent image carrier 24. In the photoreceptor drum 24, a photoconductive layer is formed on a drum-like conductive substrate of aluminum or SUS. Various known materials can be used in the photoconductive layer. For example, inorganic photoconductive materials such as $\alpha$-Si, $\alpha$-Se and $As_2Se_3$ and organic photoconductive materials such as PVK/TNF can be used. These can be formed by plasma CVD, a deposition method or a dipping method. Further, a charge transfer layer or an overcoat layer may be formed as required.

The charging device 80 uniformly charges the surface of the electrostatic latent image carrier 24 at a predetermined potential. The charging device 80 may be one which can charge the surface of the photoreceptor drum 24 at an optional potential. In this embodiment, a corotron is used in which a high voltage is applied to an electrode wire to generate corona discharge between it and the electrostatic latent image carrier 24 and uniformly charge the surface of the photoreceptor drum 24. Other various known charging units can also be used. For example, a conductive roll member, a brush or a film member is contacted with the photoreceptor drum 24, and a voltage is applied thereto to charge the surface of the photoreceptor drum.

In the light beam scanner 82, micro-spotlight is applied to the surface of the charged electrostatic latent image carrier 24 based on image signals to form an electrostatic latent image on the electrostatic latent image carrier 24. The light beam scanner 82 may be a device in which light beam is applied to the surface of the photoreceptor drum 24 according to the image information to form the electrostatic latent image on the uniformly charged photoreceptor drum 24. In this embodiment, it is a ROS (Raster Output Scanner) in which the surface of the photoreceptor drum 24 is scanned with light through a polygon mirror 84 in an image formation optical system having the polygon mirror 84, a return mirror 86 and a light source and a lens not shown while laser beam adjusted to a predetermined spot diameter is turned on or off according to the image signal. Further, a LED head in which LEDs are arranged according to desired resolution is also available.

Figure 28:
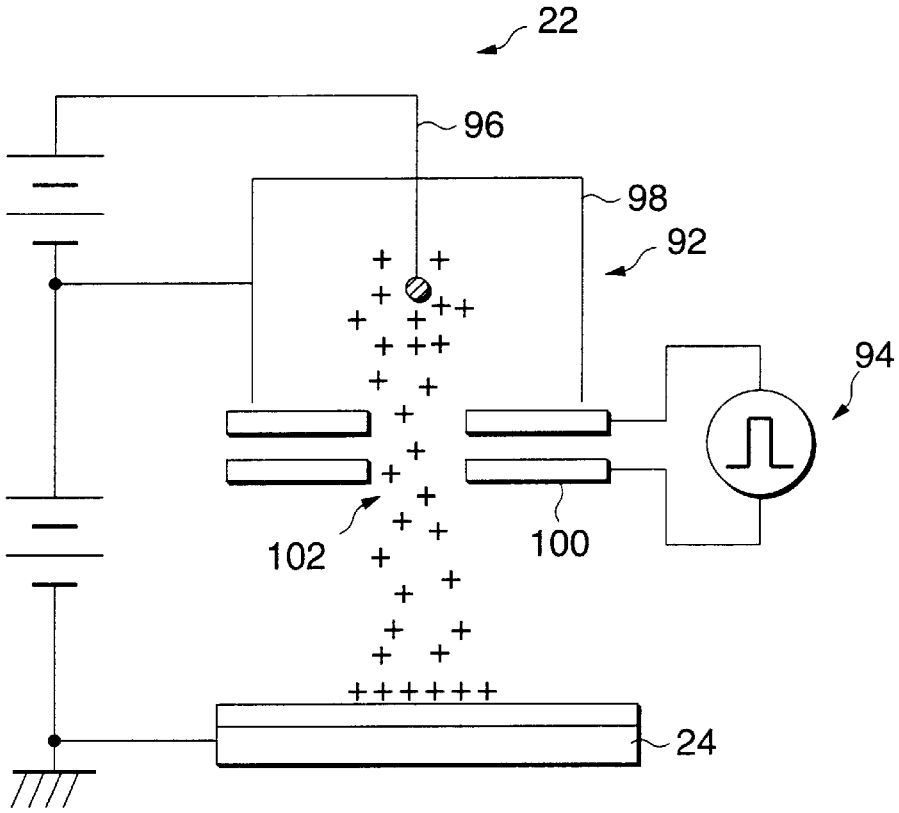
FIG. 28 is a schematic view of an ion irradiation head.

Moreover, as another example of the electrostatic latent image forming portion 22, an ion irradiation head 22 shown in FIG. 28 may be used. In this case, a dielectric drum 24 in which a dielectric layer is formed on a conductive substrate can be used as the electrostatic latent image carrier 24.

In the ion irradiation head 22, aerial ions generated in a position spaced apart from the electrostatic latent image carrier 24 are irradiated on the electrostatic latent image carrier 24 according to the image information. As shown in FIG. 28, the ion irradiation head 22 is constructed of an aerial ion-generating portion 92 and an ion stream control portion 94. The aerial ion-generating portion 92 generates aerial ions by applying a high voltage to an electrode wire 96, as shown in, for example, FIG. 28, and causing corona discharge between it and a shield member 98. Further, the ion stream control portion 94 has control electrodes 100 mounted separately in a recording width direction with desired resolution, and an opening 102 for irradiating ions generated in the aerial ion-generating portion onto the dielectric drum surface. The passage of the ions generated through the opening 102 is controlled with the polarity of the applied voltage to the control electrode 100.

The ion stream control portion 94 is mounted facing the dielectric drum 24, and the ions passed through the opening 102 are adhered to the dielectric drum 24 according to the electric field formed between the ion irradiation head 22 and the dielectric drum 24. To each control electrode 100, the voltage is applied according to the image information, and the electrostatic latent image is formed on the dielectric drum 24.

Figure 29:
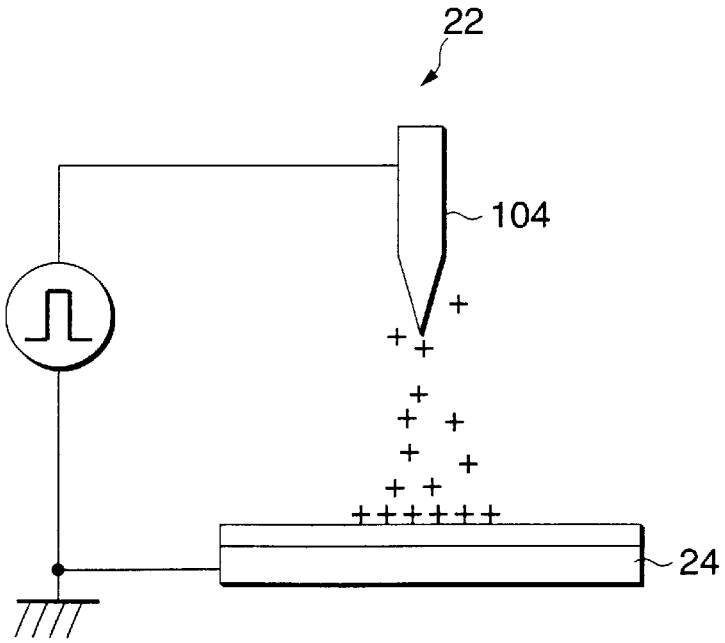
FIG. 29 is a schematic view of a stylus electrode.

As another example of the electrostatic latent image forming portion 22, a stylus electrode 22 shown in FIG. 29 may be used. In this case, the dielectric drum 24 in which the dielectric layer is formed on the conductive substrate can be used as the electrostatic latent image carrier 24.

In the stylus electrode 22, a large number of needle electrodes are arrayed to obtain desired image resolution. In the stylus electrode 22, as shown in FIG. 29, the needle electrode 104 is mounted in the vicinity of the dielectric drum 24, and a high voltage is applied between it and the conductive substrate of the dielectric drum 24 according to the image signal. Then, a high electric field acts on the tip of the needle electrode 104 in particular where the corona charge is generated. The corona charge generated is adhered to the surface of the dielectric drum 24 by the electric field formed between the needle electrode 104 and the dielectric drum 24 to charge the surface of the dielectric drum 24. Consequently, the electrostatic latent image is formed on the dielectric drum 24.

Figure 30:
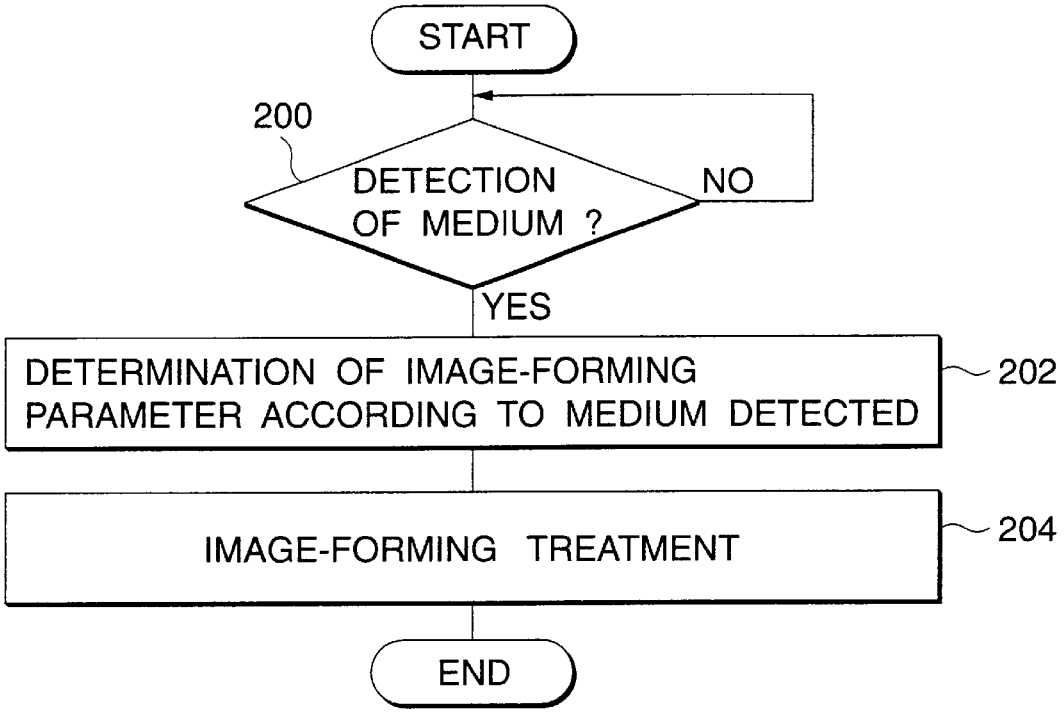
FIG. 30 is a flowchart of a control routine which is practiced in a control portion.

With respect to the function of the third embodiment, a control routine which is practiced in the control portion 60 is described by referring to FIG. 30.

In a step 200 shown in FIG. 30, it is judged whether the medium is detected with the medium-detecting sensor 58. In the medium-detecting sensor 58, light reflected by applying predetermined light (for example, infrared light) to, for example, a medium being passed is detected, and an amount of reflected light detected is measured, and outputted to the control portion 60.

When the medium is detected, it is accepted in the step 200. In a step 202, it is judged whether the medium to be transported is the image display medium 10 or the recording paper 64, according to the result detected by the medium-detecting sensor 58, namely, the amount of reflected light. On the basis of the result judged, the image-forming parameter is determined. This image-forming parameter includes, for example, an electric field-generating parameter, determination of the developing device, determination of the transport route, a rate of transportation and an exposure value.

The electric field-generating parameter is, for example, an applied voltage value in each portion. When the medium to be transported is the image display medium 10, it is an applied voltage value in each of the electrostatic latent image forming portion 22, the developing device 50 and the counter electrode 26. When the medium to be transported is the recording paper 64, it is an applied voltage value in each of the electrostatic latent image forming portion 22, the developing device 50, the transfer device 52 and the cleaning device 54.

With respect to the determination of the developing device, when the medium to be transported is, for example, the image display medium 10, the developing device 50 is, as shown in, for example, FIG. 22, moved in the arrow G direction to be spaced apart from the electrostatic latent image carrier 24. Further, when the medium is the recording paper 64, the developing device 50 is moved in the arrow G direction to be contacted with the electrostatic latent image carrier 24.

With respect to the determination of the transport route, when the medium to be transported is the image display medium 10, the transport route change-over member 68 is turned in the arrow F direction, as shown in FIG. 20, to direct the tip downward (position shown by a broken line). Consequently, the image display medium 10 can be transported upward without being passed through the fixing device 56 after the image formation. When the medium to be transported is the recording paper 64, the transport route change-over member 68 is turned in the arrow F direction to direct the tip upward. Consequently, the recording paper 64 can be transported toward the fixing device 56. In this case, the heating temperature of the fixing roller 66 is determined.

In a step 204, the image-forming treatment is conducted. That is, when the medium to be transported is the image display medium 10, as described in the first embodiment and the second embodiment, the electrostatic latent image forming portion 22 is controlled to form the electrostatic latent image on the electrostatic latent image carrier 24, and the bias voltage is applied to the counter electrode 26 to form the image on the image display medium 10. Further, when the medium to be transported is the recording paper 64, the electrostatic latent image forming portion 22 is controlled to form the electrostatic latent image on the electrostatic latent image carrier 24, and the toner development is conducted with the developing device 50. The toner image is transferred onto the recording paper 64 by the transfer device 52, and the toner image transferred is fixed by the fixing device 56. Thus, the image is formed on the recording paper 64.

In this manner, the medium is automatically detected, and the image-forming treatment is conducted according to the medium detected, whereby the image formation of the image display medium 10 capable of repetitive use and the recording paper 64 can be conducted in one apparatus. Moreover, since the various parameters are determined according to each medium and the image formation is conducted according to the same, the image quality is not deteriorated.

In this embodiment, the case of automatically detecting the medium and forming the image according to the medium detected has been described. It is also possible that users manually input whether the medium is the image display medium or the image-recording medium through an inputting unit such as a keyboard or a mouse and the image formation is conducted by changing the determination of the image-forming parameter according to the result inputted.

Fourth Embodiment

The fourth embodiment is described below by referring to the drawings. In the fourth embodiment, the formation of the color image on the image display medium is described.

Figure 31:
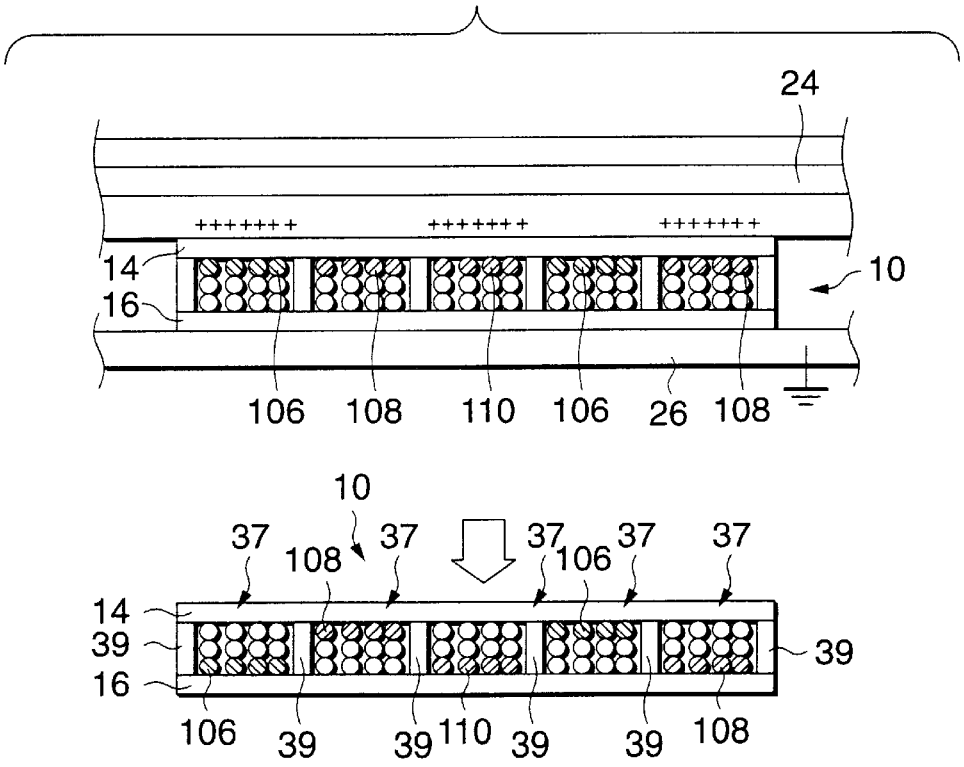
FIG. 31 is a view showing an image display medium capable of displaying a color image.

The image display medium 10 for forming the color image is, as shown in FIG. 31, the image display medium 10 having the cell structure as shown in FIG. 9 in which color particles, yellow (6Y) particles 106, magenta (6M) particles 108 and cyan (6C) particles 110 are encapsulated in the respective cells 37 in a predetermined arrangement. This image display medium 10 is transported between the electrostatic latent image carrier 24 for carrying the electrostatic latent image formed on the basis of the image signal of each color and the counter electrode 26, and the color particles in each cell 37 are moved toward the display substrate 14 according to the electric field forming the electrostatic latent image. The white particles or the black particles may be encapsulated in each cell 37. Here, it is important that the position of the electrostatic latent image formed from the image signal of each color on the electrostatic latent image carrier 24 agrees with the position of the cell 37 having therein each color of the image display medium 10. With respect to the colors of the color particles, the color reproduction zone may be adjusted by adding red (R), green (G), blue (B) and black (K) as required.

Especially regarding black (K), instead of the movement of the charged particles by the electric field, the black display may be conducted by encapsulating the magnetic black particles in the cells 37 along with the other color particles and moving the same toward the display substrate 14 with a magnetic attractive force based on the image signal. At this time, the magnetic attractive force based on the image signal can be applied with, for example, a magnetic stylus.

The color particles in each cell 37 can be charged by the methods described in the first embodiment and the second embodiment, namely, the method in which the charging is conducted before the step of conducting the image formation and the method in which the charges are injected according to the electric field to form the electrostatic latent image. It is also possible to use particles containing at least a charge-transferring material and a coloring agent. Good charging properties and good color formation can be secured by selecting a colorless transparent material as the charge-transferring material.

The image formation of the color image is basically the same as the treatment shown in the third embodiment. In this embodiment, the electrostatic latent images of the respective colors are once formed on the electrostatic latent image carrier 24 according to the color image signals. Consequently, the color particles encapsulated in the cells of the image display medium 10 are moved toward the display substrate 14 according to the electrostatic latent images of the respective colors. Thus, the color image can be formed by one image-forming step.

Here, in a tandem-type color printer, for example, images of colors are formed on four photoreceptors, and transferred onto paper overlappingly four times. Accordingly, the pixel positioning of the colors on the paper is a great problem. Further, even in a 4-cycle-1-copy-type color printer, the images of the colors formed on one photoreceptor are transferred onto paper overlappingly four times. Thus, the same problem is posed. On the contrary, in the invention, the color image can be formed by moving the particles of the plural colors through one image-forming step. Thus, it is sufficient that the pixel position of the cell 37 on the image display medium 10 and the pixel position of the electrostatic latent image are matched only once. Further, the color image can be formed more easily at high speed.

As has been stated above, according to the invention, the image is formed by moving the particle groups interposed between the pair of substrates having the charge-transporting property by the electric field applied from outside according to the image. Thus, there are the effects that the repetitive rewriting is enabled and the safety and the response are excellent.

What is claimed is:

1. An image display medium comprising:

a pair of substrates, at least one of which has a charge-transporting property and which has a surface that is exposed to an area external to the display medium; and plural types of particle groups contained between the substrates and movable by an electric field applied from outside, the plural types of particle groups being different from each other in at least one of color and property, at least one of the plural types of particle groups having particles in contact with at least one of the pair of substrates when the electric field is applied, wherein at least one substrate having the charge-transporting property allows charges to pass from the area external to the display medium to an area internal to the display medium through that at least one substrate.

2. The image display medium as claimed in claim 1, wherein at least one type of the particle groups is of conductive particles.

3. The image display medium as claimed in claim 1, further comprising:

a cell structure composed of cells of a predetermined shape between the substrates.

4. The image display medium as claimed in claim 3, wherein at least one type of the particle groups is of conductive particles and the conductive particles are contained in the cells corresponding to respective plural colors forming a multicolor image.

5. An image-forming method in which the image is formed on an image display medium comprising a pair of substrates at least one of which has a charge-transporting property and which has a surface that is exposed to an area external to the display medium and plural types of particle groups contained between the substrates and movable by an electric field applied from outside, the plural types of particle groups being different from each other in at least one of color and property, the method comprising the steps of:

forming on a latent image carrier an electrostatic latent image corresponding to an image; and generating an electric field between a counter electrode and the latent image carrier, the counter electrode being mounted in a position facing the latent image carrier such that the image display medium can be positioned therebetween, at least one of the plural types of particle groups having particles in contact with at least one of the pair of substrates when the electric field is applied, wherein the at least one substrate having the charge-transporting property allows charges to pass from the area external to the display medium to an area internal to the display medium through that at least one substrate.

6. An image-forming apparatus for forming an image on an image display medium, comprising:

the image display medium comprising a pair of substrates at least one of which has a charge-transporting property and which has a surface that is exposed to an area external to the display medium and plural types of particle groups which are contained between the substrates and movable by an electric field applied from outside, the plural types of particle groups being different from each other in at least one of color and property;

a latent image carrier;

electrostatic latent image forming means for forming on the latent image carrier an electrostatic latent image corresponding to an image; and a counter electrode for generating an electric field between itself and the latent image carrier, the counter electrode being mounted in a position facing the latent image carrier such that the image display medium can be positioned therebetween, at least one of the plural types particle groups having particles in contact with at least one of the pair of substrates when the electric field is applied, wherein the at least one substrate having the charge-transporting property allows charges to pass from the area external to the display medium to an area internal to the display medium through that at least one substrate.

7. The image-forming apparatus as claimed in claim 6, wherein a bias voltage is applied to the counter electrode.

8. The image-forming apparatus as claimed in claim 6, wherein at least one type of the particle groups is of conductive particles, the image-forming apparatus further comprising:

charging means for previously charging the conductive particles.

9. The image-forming apparatus as claimed in claim 6, wherein at least one type of the particle groups is of conductive particles, the image-forming apparatus further comprising:

charging means for previously charging the conductive particles by applying at least one of a DC voltage and an AC voltage to the substrates.

10. The image-forming apparatus as claimed in claim 6, wherein at least one type of the particle groups is of conductive particles, the image-forming apparatus further comprising:

charging means for previously charging the conductive particles, the charging means being made of an elastic material and applying at least one of a DC voltage and an AC voltage to the substrates in a state closely adhered to the image display medium.

11. The image-forming apparatus as claimed in claim 6, wherein at least one type of the particle groups is of conductive particles, the image-forming apparatus further comprising:

charging means for previously charging the conductive particles, the substrate having the charge-transporting property being earthed before conducting the charging by the charging means.

12. An image-forming apparatus for forming an image on an image display medium, comprising:

the image display medium comprising a pair of substrates at least one of which has a charge-transporting property and which has a surface that is exposed to an area external to the display medium and plural types of particle groups which are contained between the substrates and movable by an electric field applied from outside, the plural types of particle groups being different from each other in at least one of color and property, at least one of the plural types of particle groups having particles in contact with at least one of the pair of substrates when the electric field is applied, wherein the at least one substrate having the charge-transporting property allows charges to pass from the area external to the display medium to an area internal to the display medium through that at least one substrate;

a latent image carrier;

electrostatic latent image forming means for forming on the latent image carrier an electrostatic latent image corresponding to an image;

a counter electrode for generating an electric field between itself and the latent image carrier, the counter electrode being mounted in a position facing the latent image carrier such that the image display medium can be positioned therebetween;

inputting means for inputting whether a medium on which the image is formed is the image display medium for an image-recording medium;

developing means for developing the electrostatic latent image formed by the electrostatic latent image forming means with a toner when the result inputted by the inputting means is the image-recording medium;

transferring means for transferring the toner image developed by the developing means onto the image-recording medium; and fixing means for fixing the toner image transferred onto the image-recording medium.

13. The image-forming apparatus as claimed in claim 12, wherein the inputting means is medium-detecting means for detecting whether the medium on which the image is formed is the image display medium or the image-recording medium.

14. The image-forming apparatus as claimed in claim 12, wherein the transferring means is the counter electrode.

15. The image-forming apparatus as claimed in claim 12, wherein when the result inputted by the inputting means is the image display medium, the fixing by the fixing means is not conducted.

16. The image-forming apparatus as claimed in claim 12, further comprising:

development-stopping means for stopping the development by the developing means when the result inputted by the inputting means is the image display medium.

17. An initializer for initializing the image display medium as claimed in claim 1.

* * * * *